US006457731B1

(12) United States Patent
Paranto et al.

(10) Patent No.: US 6,457,731 B1
(45) Date of Patent: Oct. 1, 2002

(54) SIDE WHEELS FOR SCOOTER BOARDS

(76) Inventors: Arlen C. Paranto, 200 Orchard Ave. South, Eatonville, WA (US) 98328; Steven A. Paranto, 6515 SW. Lois St., Hillsboro, OR (US) 97123

( * ) Notice: Subject to any disclaimer, the term of this patent is extended or adjusted under 35 U.S.C. 154(b) by 0 days.

(21) Appl. No.: 09/825,565

(22) Filed: Apr. 2, 2001

(51) Int. Cl.[7] ..... B62M 1/14
(52) U.S. Cl. ..... 280/249; 280/208
(58) Field of Search ..... 280/242.1, 249, 280/250, 208, 233, 235, 259

(56) References Cited

U.S. PATENT DOCUMENTS 1,268,310 A * 6/1918 Wilkinson ..... 280/242.1
3,854,754 A * 12/1974 Jablonski ..... 280/242.1
4,066,273 A 1/1978 Lohr ..... 280/211
4,077,647 A 3/1978 Nagayama ..... 280/211
4,655,470 A 4/1987 Lin ..... 280/211
4,795,181 A 1/1989 Armstrong ..... 280/87.04
5,062,630 A 11/1991 Nelson ..... 272/111
5,639,105 A 6/1997 Summo ..... 280/250.1

* cited by examiner

*Primary Examiner*—Kevin Hurley
(74) *Attorney, Agent, or Firm*—Keith D. Gehr

(57) ABSTRACT

An attachment for affixing hand operated side wheels to a scooter board is described. The attachment has a frame, preferably made from a metal strap with up-turned ends. The ends are sufficiently spaced to accommodate a scooter board placed between them. Each end has a short axle on which a wheel is mounted. The wheels have an outwardly oriented offset handle acting as a crank to propel the attachment when combined with a scooter board. A washer and bolt passing through the center hole of the scooter board is sufficient to mount the attachment. Slotted indexing blocks attached to the frame engage reinforcing ribs on the underside of the scooter board to prevent rotation of the attachment.

7 Claims, 3 Drawing Sheets

SIDE WHEELS FOR SCOOTER BOARDS

The present invention relates to readily installed hand operated side wheels that greatly extend the usefulness of scooter boards used in physical education classes.

BACKGROUND OF THE INVENTION

A scooter board is a molded plastic device having a square planar upper surface with caster wheels mounted at each lower corner. The device has a reinforcing rim depending from the edges and molded bracing on the lower surface. Optionally it may have handles on opposing sides. Scooter boards are widely used in lower grade physical education programs. Sizes are relatively standardized with generally two sizes being available. Typically they will be about 12 inches square, or about 12×16 inches with handles. The boards will have a hole in the center for stacking on a short pole for storage. The user sits on the device and propels him or herself using the feet and/or hands pushing against the floor. Links are available to couple two or more of the boards together for cooperative play.

While not based on scooter boards, other devices are known in which a sitting occupant can drive the device with using the hands or hands and feet. Examples are seen in U.S. Pat. No. 4,077,647 to Nagayama and U.S. Pat. No. 4,655, 470 to Lin. However, both of these devices are relatively complex, bulky, and expensive and cannot be broken down for other uses or storage. Each has a seat and foot rest with a pair of side mounted wheels having crank-type handles that can be used for propulsion. A somewhat similar device is shown in U.S. Pat. No. 5,062,630 to Nelson. A more complex hand propelled wagon-like apparatus is shown in U.S. Pat. No. 5,639,105 to Summo. Armstrong, in U.S. Pat. No. 4,795,181 shows a skateboard with side wheels but this is foot propelled from a standing position.

No scooter board version has been available that enables rapid hand propulsion enabling spins and turns, as well as forward or rearward movement. Neither has any simple attachment been available to readily convert a scooter board to such a device until the present.

SUMMARY OF THE INVENTION

The present invention is an easily installed or removed attachment for a scooter board that enables hand propulsion and ready maneuverability. The attachment has a frame formed from a rigid strap with end portions that are turned up at right angles for a short distance. The end portions each have a short, outwardly oriented axle. A pair of side wheels are installed on the axles. Each wheel has an outwardly oriented handle that serves as a crank to enable hand propulsion. The wheels and upstanding end portions of the frame are sized so that when the attachment is installed on a scooter board the wheels will contact the floor below the plane of the casters on the scooter board. A means is provided with which the device may be attached at the central opening of the scooter board. This may be a simple tapped hole centrally located in the frame. A bolt and washer passing through a bushing placed in the central hole of the scooter board unites the board and side wheel assembly. Indexing means are also provided on the frame to engage one of the reinforcing ribs on the underside of the scooter board and prevent rotation of the side wheel attachment. The indexing means is typically a pair spaced apart slotted blocks permanently attached to the frame. The slots are sized to snugly engage an opposing reinforcing rib.

The side wheel device consists of only six parts: the frame, two wheels, two axle caps and the attachment bushing and bolt. The wheel handles may optionally also be removed to reduce package size. This allows disassembled shipping in a minimal sized package and simple assembly at the point of use.

A simple coupling may be provided to enable two scooter boards to be attached to one another at the handles. This provides a leg and foot rest for the user. Another accessory may be an extended rail having a caster at one end and a clamp allowing attachment to the handle of a scooter board at the other end. A short cross piece adjacent the caster location provides a foot rest for the user.

It is an object of the invention to provide a set of side wheels for a scooter board that enables the user to hand propel the board.

It is another object to provide scooter board side wheels that may be readily installed or removed without altering the scooter board in any manner.

It is a further object to provide side wheels for a scooter board that may be shipped disassembled and compactly packaged yet may be readily assembled for use with minimum tool requirements.

These and many other objects will become readily apparent upon reading the following detailed description taken in conjunction with the drawings.

DETAILED DESCRIPTION OF THE PREFERRED EMBODIMENTS

Figure 1:
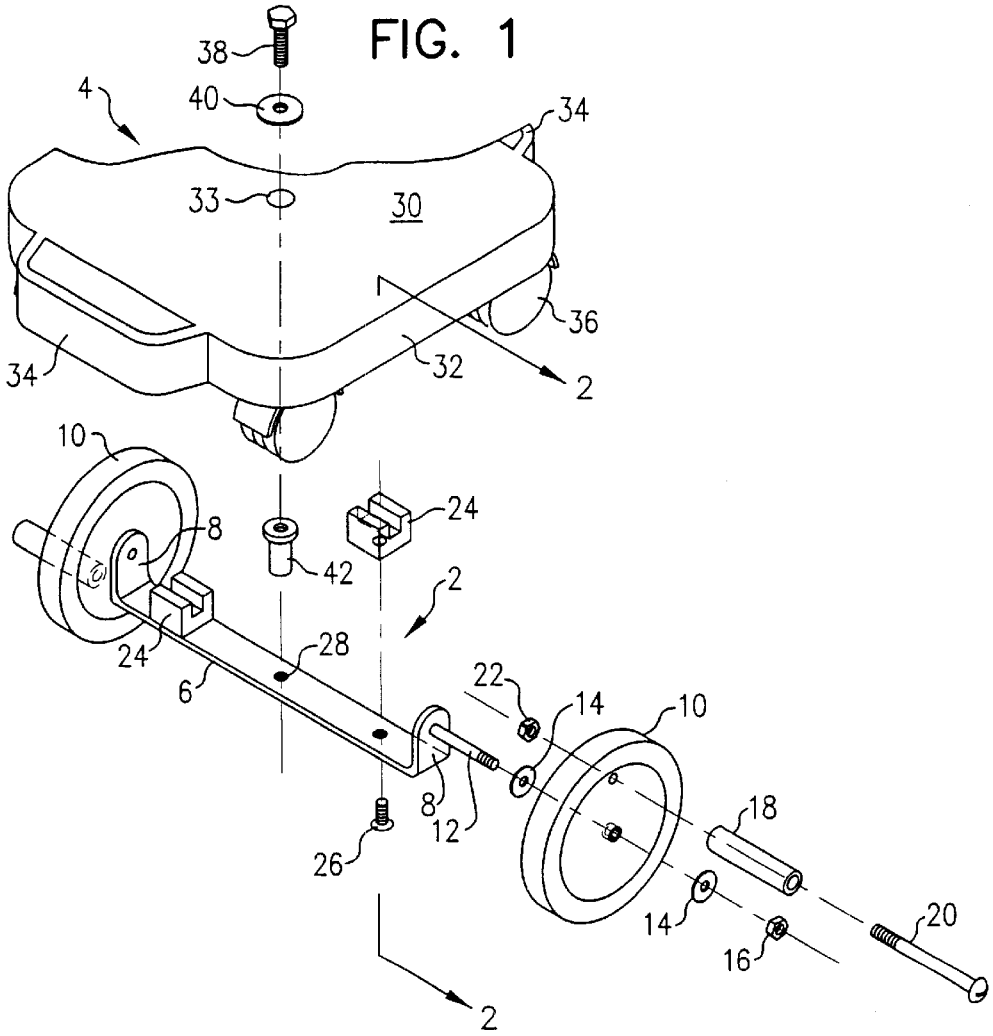
FIG. 1 is an exploded view of the side wheel device shown adjacent to a scooter board.

Reference should now be made to the drawings to understand construction and use of the side wheel attachment. The attachment itself is generally indicated at 2 and is seen adjacent a typical scooter board shown at 4. The side wheel attachment has a frame 6. This is preferably formed from a simple piece of rigid strap iron about 1½ inches wide and 3/16 inch thick, although this material and size is not critical. The frame has upturned ends 8. The ends are preferably at right angles to the longer part of the frame although the angle may somewhat exceed 90°. A pair of wheels 10 are mounted on short axles 12 fixed in the upturned frame ends. The axis through the axles will be parallel to the longer part of the frame. The wheels are held between washers 14 and secured with a nut or push on axle cap 16. Each wheel has an offset handle 18 held by an elongated bolt 20 and nut 22. Handles are allowed to rotate on the bolt and may have a flange at the end adjacent the wheel to prevent hand abrasion. The handles serve as cranks to enable propulsion of the mounted side wheel device. Preferably, a pair of spaced apart slotted indexing blocks 24 are provided. These are held to frame 6 by bolts 26. Alternatively, other indexing means might be used such as bolts through the scooter board or a mechanism that would clamp the frame to the edges of the s board. A centrally located threaded hole 28 is provided in the frame to allow attachment to the scooter board. This may also be a simple drilled hole for use with a bolt and nut or may be a projecting stud secured from above. While the simple construction shown is preferred, it is within the scope of the invention for the frame to constructed of other materials. The term "rigid strap" used above should be read broadly since there are many mechanical equivalents. For example, it could be made from channel piece or a molded engineering plastic material with the indexing blocks integrally formed.

Figure 2:
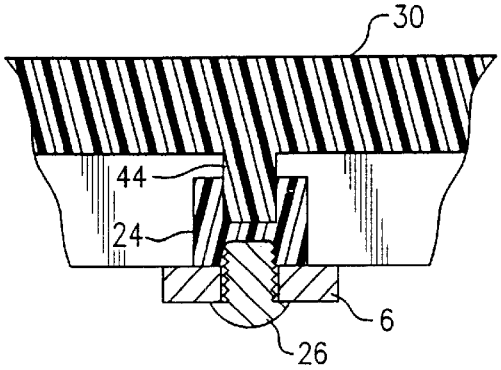
FIG. 2 is a partial cross section through line 2—2 of FIG. 1.

Scooter board 4 is typically a molded plastic material having an essentially planar deck surface 30 with a depending reinforcing rim 32. The board further has molded in reinforcing cross bracing beneath the deck surface (See FIG. 2 at 44). The boards almost universally will have a molded in central hole 33 that enables stacking on a short pole for compact storage when not in use. Optionally, they may have integral opposing handles 34. Four casters 36, one at each corner, complete the scooter board construction. Scooter boards are available from a number of vendors. While there are minor variations in size and construction the overwhelming majority will fall within the generic description just given.

Figure 4:
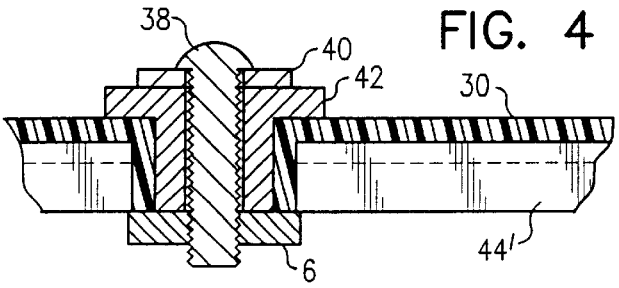
FIG. 4 is a partial section through line 4—4 of FIG. 3.

The scooter board may be simply linked to the side wheel attachment using a machine bolt 38 and washer 40. A bushing 42 is provided to snugly fit within the central hole 33. This is shown in cross section in FIG. 4. A more preferred form of bolt, from the standpoint of comfort of the user, is a thin steel plate having a welded depending ¼-20 stud. A plate about 1/16 inch thick by ¾ inch wide and 2 inches long has been very satisfactory. However, these dimensions are not at all critical. The side wheels thus may be simply installed or removed using only a simple tool such as a screwdriver or wrench.

The axle placement on the upturned ends 8, and the side wheel diameter, is such that the wheels will contact the floor below the plane of the scooter board casters when the board is level. Typically this height differential will be only about ¼ inch, although this distance may vary somewhat. This allows for a teeter-totter effect so that the hand powered side wheels will always be in contact with the floor but no more than two of the caster wheels will have floor contact. The clearance should not be too great or tipping can result. Preferred wheels will have a rubber tread for good traction. Typical wheel diameters are about 10 inches for small children and 12 inches for larger children.

Figure 3:
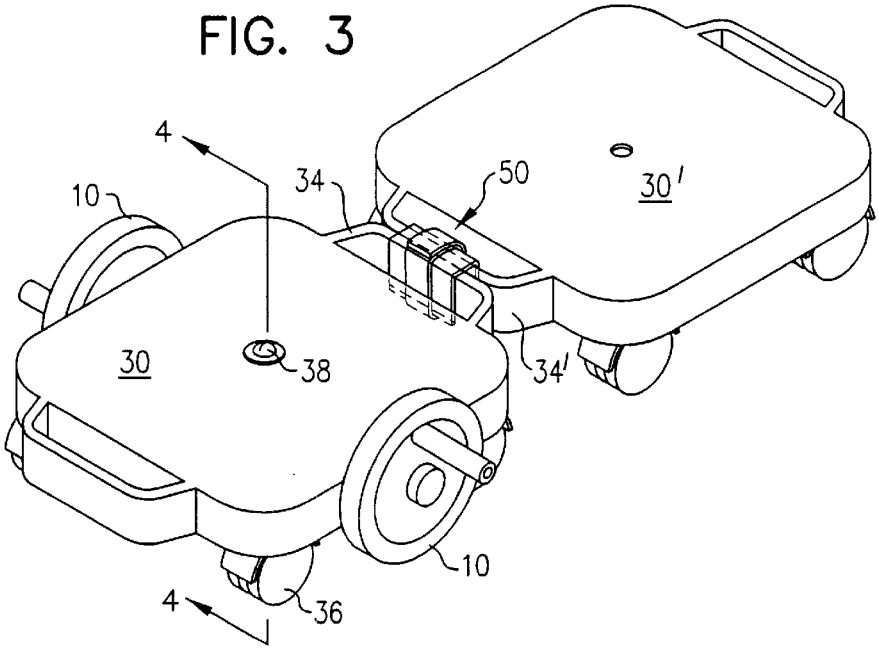
FIG. 3 shows the side wheel attachment installed on a scooter board that linked to a second scooter board.
Figure 5:
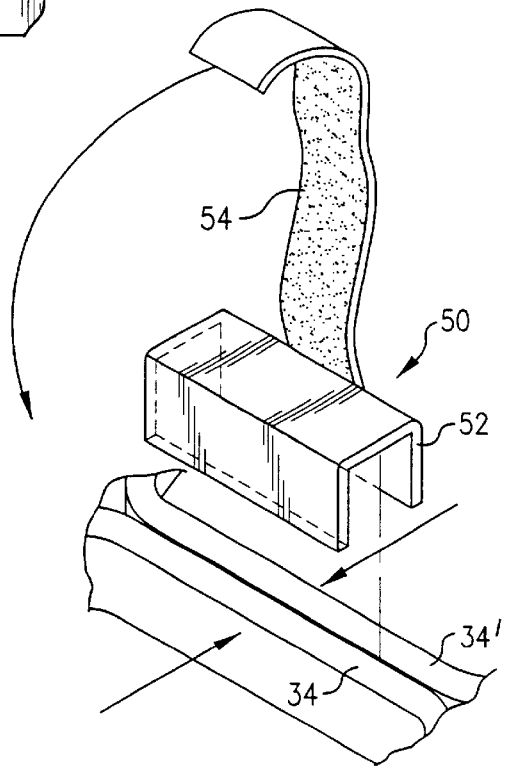
FIG. 5 is an exploded view showing details of one device used to link together two scooter boards.
Figure 6:
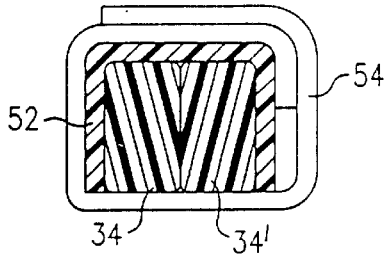
FIG. 6 is a cross section through linked area of two scooter boards joined by the device of FIG. 5.

For use solely by hand propulsion it is helpful if provision is made for a foot rest. This may readily be accomplished in a number of ways. The simplest is to link two scooter boards together. One simple way of doing this is shown in FIGS. 3, 5, and 6. As seen in FIG. 3, two scooter boards are placed in a handle-to-handle relationship. One has the side wheels attached and the other is in its normal configuration. A coupling generally shown at 50 unites the boards at their handles. FIG. 5 shows construction of this coupling. It consists of a short channel 52 sized to fit fairly snugly over the adjacent handles 34, 34'. A Velcro strip 54 is attached at one end of the channel to prevent loss. This is simply wrapped around the assembly, as seen in FIG. 6 to unite the two boards. The extended length provided by the second scooter board is adequate to provide foot space.

Figure 7:
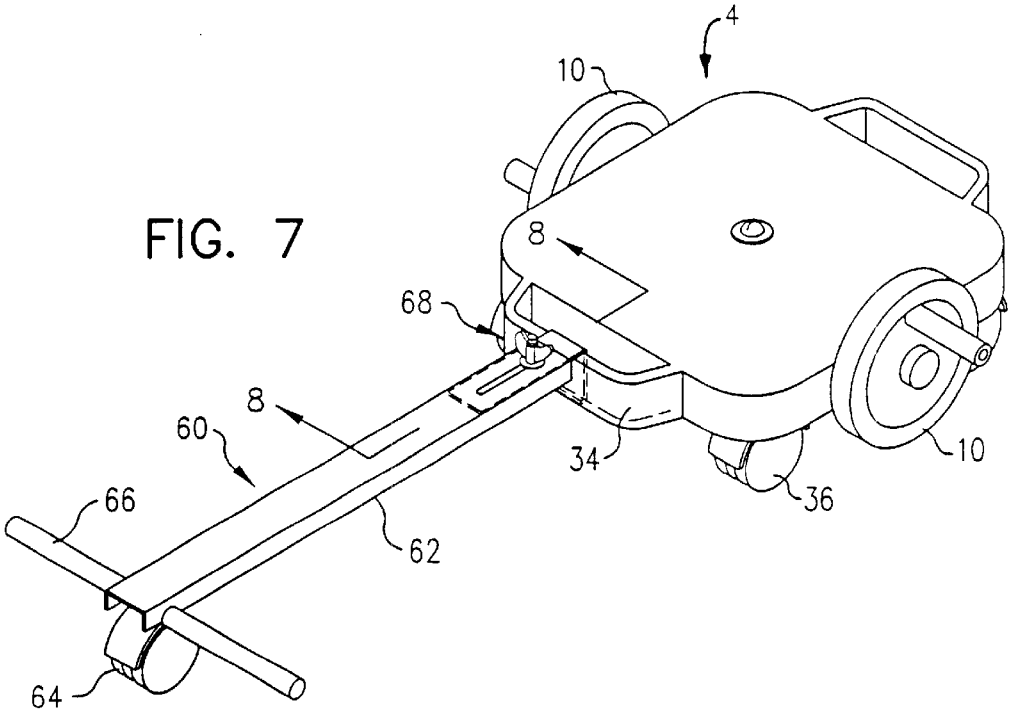
FIG. 7 illustrates an outrigger useful as a footrest linked to a scooter board.
Figure 8:
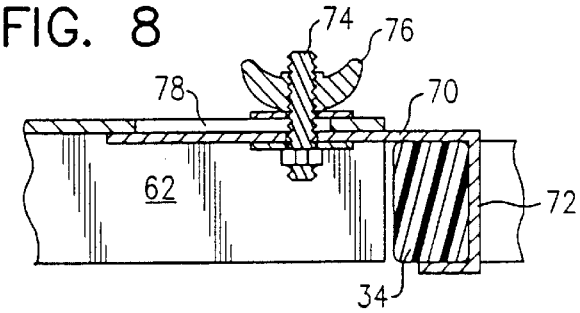
FIG. 8 is a partial cross section along line 8—8 of FIG. 7.

An alternative arrangement 60 for a foot rest is seen in FIGS. 7 and 8. A channel 62 is fitted with a caster 64 at one end. An adjacent cross piece 66 provides a foot rest. The opposite end of the channel has a latch 68 to couple the extension to one of the handles 34 of the scooter board. The latch is seen in cross section in FIG. 8. It has a moveable hook shaped piece 72 that engages handle 34. This can be slipped back and forth along the underside of channel 62. A wing nut assembly 74, 76 slides along slot 78 in the channel to permit locking or unlocking the latch.

It will be recognized by those skilled in the art that many variations could be made in construction of the side wheel device that have not been described or shown herein. It is the inventors' intention that these should be included within the scope of the invention if encompassed within the following claims.

We Claim:

1. An attachment providing side wheels for hand propulsion of a scooter board, the scooter board having a generally planar deck with depending reinforcing ribs, casters mounted at the corners, and a central opening for stacking, which comprises:

a frame formed from a rigid strap with end portions upturned at essentially right angles, the ends being sufficiently spaced apart to encompass a scooter board placed between them;

an outwardly oriented axle mounted on each of the upturned end portions;

wheels mounted on each of the axles, each wheel having an outwardly oriented offset handle serving as a crank;

means to affix the attachment to the central opening of a scooter board; and means mounted on the frame to engage the scooter board so as to prevent rotation of the attachment.

2. The attachment of claim 1 in which the handles have stationary means to affix them to the wheels and the handles are free to rotate on the affixing means.

3. The attachment of claim 1 in which the rotation prevention means is a spaced apart pair of slotted blocks adapted to engage a reinforcing rib of the scooter board.

4. A scooter board equipped for hand propulsion which comprises:

a scooter board having a generally planar deck with depending reinforcing ribs, casters mounted at the corners, and a central opening;

an attachment providing side wheels mounted beneath the scooter board, the attachment further comprising;

a frame formed from a rigid strap with end portions upturned at essentially right angles, the ends being sufficiently spaced apart to encompass the scooter board placed between them;

an outwardly oriented axle mounted on each of the upturned end portions;

wheels mounted on each of the axles, each wheel having an outwardly oriented offset handle serving as a crank;

means affixing the attachment to the central opening of the scooter board; and means mounted on the frame engaging a depending rib of the scooter board to prevent rotation of the attachment.

5. The scooter board of claim 4 in which the wheels are of a diameter sufficient to contact a plane below a parallel plane defined by the bottoms of the scooter board casters.

6. The scooter board of claim 4 linked to an unmodified scooter board, the scooter boards having handles and being linked at the handles.

7. The scooter board of claim 4 in combination with an extended rail, one end of the rail having a clamp to affix it to the scooter board, the other end having a caster and an adjacent cross piece, the cross piece serving as a foot rest for a user.

* * * * *